United States Patent [19]

DeKoker

[11] 4,421,030

[45] Dec. 20, 1983

[54] IN-LINE FUZE CONCEPT FOR ANTIARMOR TACTICAL WARHEADS

[75] Inventor: Jon G. DeKoker, Renton, Wash.

[73] Assignee: The Boeing Company, Seattle, Wash.

[21] Appl. No.: 311,907

[22] Filed: Oct. 15, 1981

[51] Int. Cl.[3] ..... F42C 15/40; F42C 19/00; F42B 13/10

[52] U.S. Cl. ..... 102/218; 102/204; 102/206; 102/476

[58] Field of Search ..... 102/218, 219, 220, 216, 102/206, 204, 476

[56] References Cited

U.S. PATENT DOCUMENTS

| | | | |
|---|---|---|---|
| 2,764,092 | 9/1956 | Massey . | |
| 3,088,409 | 5/1963 | Yavelberg | 102/218 |
| 3,188,953 | 6/1965 | Bianchi et al. | 102/218 |
| 3,373,687 | 3/1968 | Simmons . | |
| 3,410,212 | 11/1968 | Drimmer . | |
| 3,416,449 | 12/1968 | Brothers . | |
| 3,722,415 | 3/1973 | Lunt | 102/216 |
| 3,726,217 | 4/1973 | Dedman et al. | 102/204 |
| 3,906,860 | 9/1975 | Johns . | |
| 3,968,945 | 7/1976 | Walton . | |
| 3,977,330 | 8/1976 | Held . | |
| 4,020,765 | 5/1977 | Glass et al. . | |
| 4,034,673 | 7/1977 | Schneider, Jr. . | |
| 4,320,704 | 3/1982 | Gawlick et al. | 102/218 |

FOREIGN PATENT DOCUMENTS

| | | |
|---|---|---|
| 1054322 | 6/1955 | France . |

*Primary Examiner*—Charles T. Jordan
*Attorney, Agent, or Firm*—Finnegan, Henderson, Farabow, Garrett & Dunner

[57] ABSTRACT

An electronic safe and arm device for generating a trigger signal for initiating detonation of a flying plate detonator. A toroidal trigger capacitor surrounds the electronics of the device and will be shorted to disable the safe and arm device if damage occurs thereto. First and second sensor switches responsive to selected flight parameters control the charging of the trigger capacitor. A normally closed arm enable switch prevents the charging of the trigger capacitor until after break-wire launch has occurred.

11 Claims, 4 Drawing Figures

IN-LINE FUZE CONCEPT FOR ANTIARMOR TACTICAL WARHEADS

FIELD OF THE INVENTION

This invention relates with particularity to an inert safe and arm device for supplying a trigger signal to a detonator in a warhead.

BACKGROUND OF THE INVENTION

Hot wire detonators in existing tactical warhead safe and arm devices explode readily if exposed to high temperatures, shock, static discharges, or electromagnetic interference induced currents. For this reason, military standards require that safe and arm designs have a physical barrier between the detonator and the warhead explosive to provide safety in the event of premature detonator firing. This barrier must be mechanically removed during the warhead arming sequence. Mechanical failure is common, and packaging flexibility within the warhead is limited with the use of mechanical safe and arm devices.

For shaped-charge antiarmor warheads employed in tactical minimissiles such as WASP or the Assualt Breaker terminally guided submissiles, the length required for mechanical safe and arm devices is an appreciable percentage of the total length allocated for ordnance. Also, it is common for such minimissiles to include an infrared or millimeter wave seeker which further requires space within the warhead. Thus, the actual amount of explosives carried by the warhead is unduly limited and the resulting problem is compounded by the fact that the warheads are required to defeat increasingly resistant armored targets.

A partial solution to the problems arising from the use of mechanical safe and arm devices is a safe and arm device which uses a flying plate or slapper detonator. Such flying plate detonators are known in the art and can initiate insensitive secondary explosives such as hexanitrosostilbene (HNS) directly and, therefore, do not require barriers in the explosive train. The length required for such a flying plate detonator is only 0.040 inch (1 millimeter). An (HNS) explosive acceptor pellet is embedded in the warhead explosive to provide a completely inert safe and arm device in a manner that greatly simplifies the assembly, testing, and logistical concerns associated with the warhead.

Flying plate detonators, as known in the art, require a firing current of approximately 1500 amperes for a few microseconds. This characteristic makes the safe and arm device immune to static discharges and electromagnetic interference. Direct connection with a 60 hz, 110 V or 220 V current or with 28 V DC missile battery power will dud the detonator and will not initiate an explosion. The HNS pellet is as insensitive to heat as the LX-14 explosive commonly employed in a warhead. This type of explosive burns rather than detonates if exposed to flame.

The flying plate detonator has not, however, provided a complete solution to the need for a safe and arm device for tactical missiles and warheads. This is because it is necessary to provide a compact and reliable triggering circuit for initiating the detonation of the flying plate detonator. Since there is no mechanical barrier employed within the flying plate detonator, it is extremely important that the triggering circuit not generate transient or spurious signals capable of triggering the detonator.

OBJECTS AND SUMMARY OF THE INVENTION

It is, therefore, an object of the present invention to trigger a flying plate detonator in a reliable manner.

Another object of this invention is to prevent the triggering of a flying plate or other safe and arm device in the event that damage occurs to the triggering circuit.

Yet another object of this invention is to include all of the components of a triggering circuit of a flying plate or other detonator in a compact manner that will not decrease the amount of room available in the warhead for explosives.

These and other objects are accomplished by a safe and arm device for supplying a trigger signal to an explosive detonator in a warhead flown to impact a target, comprising a power source, means for selectively coupling the power source to the trigger capacitor to charge the trigger capacitor, and means responsive to the impact of the warhead against the target for enabling the discharge of the trigger capacitor to generate the trigger signal.

BRIEF DESCRIPTION OF THE DRAWINGS

The accompanying drawings which are incorporated in and constitute a part of the specification, illustrate an embodiment of the invention and, together with the description, serve to explain the principles of the invention.

DETAILED DESCRIPTION OF THE PREFERRED EMBODIMENT

Figure 1:
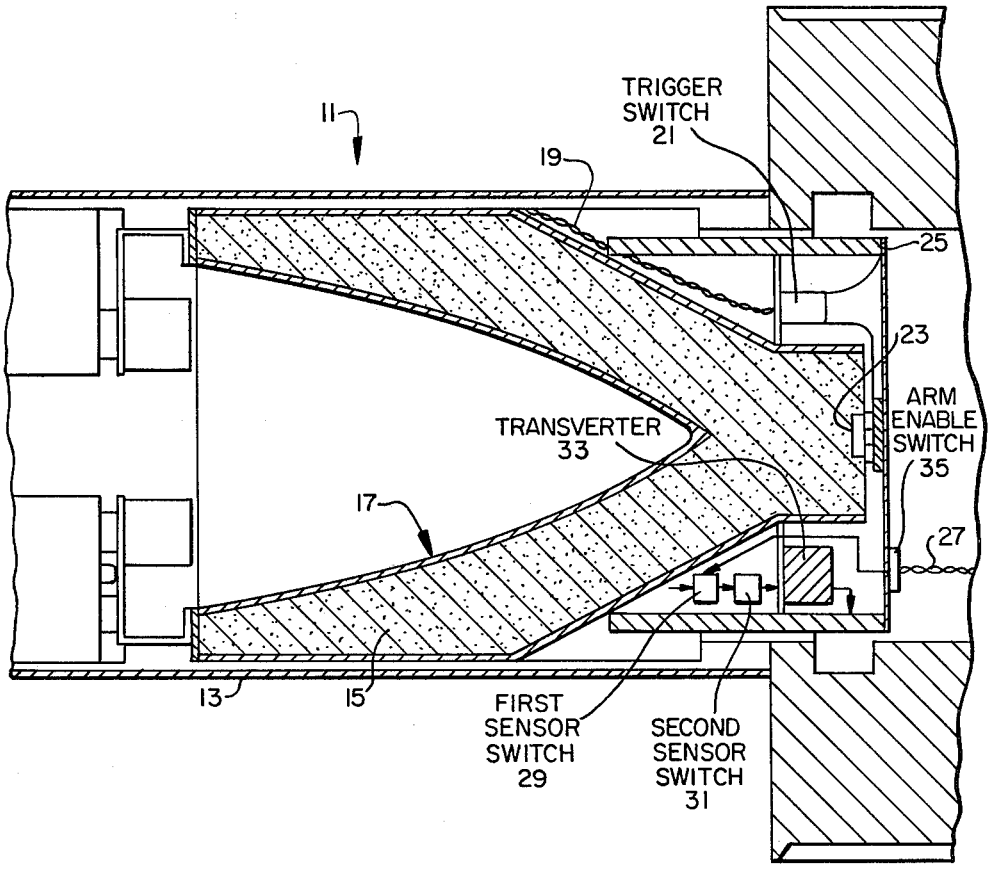
FIG. 1 is a partial cross section of a warhead incorporating the safe and arm triggering circuit of the instant invention.

A partial cross section of a warhead 11 is illustrated in FIG. 1. The warhead 11 includes a warhead casing 13 and a shaped charge explosive 15. A copper liner 17 is provided on the interior surface of the shaped charge 15.

A target impact sensor (not shown) is provided in the warhead 11 to generate an impact signal at the time that the warhead 11 strikes its assigned target or some other solid object. This impact signal is supplied over an impact signal line 19 connected to a trigger switch 21. The trigger switch 21 is connected to a detonator 23 and to a high voltage trigger capacitor 25. The impact trigger switch 21 is normally an open circuit between the detonator 23 and the trigger capacitor 25. Upon receiving an impact signal from the impact signal line 19, the trigger switch 21 directly connects the detonator 23 to the trigger capacitor 25 and permits the trigger capacitor 25 to generate a trigger signal by discharging through the detonator 23.

The warhead 11 further includes a circuit for charging the trigger capacitor 25 under specified conditions. This circuit includes a power source input 27 connected to a power source 51 (FIG. 3) and to a first sensor switch 29. A second sensor switch 31 is connected between the first sensor switch 29 and a DC-DC transverter 33. The transverter 33, upon receiving power from the power source 51, charges the trigger capacitor 25.

The first sensor switch 29 receives an input signal corresponding to the jettisoning of the nose cap (not shown) covering the seeker of the warhead 11. As known to one of ordinary skill in the art, it is common for a warhead 11 to have a seeker for acquiring a target and guiding the warhead thereto. During the launch of the warhead 11 and the initial portion of its flight, a nose cap covers and protects the seeker. The nose cap is commonly jettisoned in response to the warhead 11 obtaining a certain predetermined acceleration.

The first sensor switch 29 is normally open to prevent current from passing to the second sensor switch 31. However, upon receiving the signal indicating the jettisoning of the warhead nose cap, the first sensor switch 29 is closed.

The second sensor 31 switch is normally open and, therefore, will interrupt the flow of current to the transverter 33 even when the first sensor switch 29 is closed. The second sensor switch will close upon the occurrence of a second condition of the warhead 11. For example, the second sensor switch 31 may comprise a Rolamite accelerometer which will close the contacts of switch 31 when the proper launch acceleration magnitude and direction are sensed by the inertial navigational system (not shown) included on board the warhead 11. Such an accelerometer besides sensing the acceleration of the warhead 11 is also electronically timed. The second sensor switch 31 will not be closed if either the acceleration duration or magnitude is below specified limits. Moreover, even if the acceleration profile is acceptable, the second sensor switch 31 will not be closed until a specified time period has elapsed corresponding to a safe separation distance of the warhead from its associated carrier.

An arm enable switch 35 further interrupts the flow of current from the power source 51 over the lead 27 to the first sensor switch 29. The arm enable switch is normally closed and is opened only upon the occurrence of a signal indicating the launch of the warhead 11. Such an electrical signal may be triggered by a break-wire launch. A break-wire launch, as is recognized by one skilled in the art, requires warhead motor ignition, retraction of the warhead retaining clamp, and initial motion of the warhead.

As illustrated in FIG. 1, the trigger capacitor 25 is toroidally shaped and provided near the neck of the shaped charge 15. Moreover, the detonator 23, first sensor switch 29, second sensor switch 31, DC-DC transverter 33, and impact trigger switch 21 are surrounded by the trigger capacitor 25. In case of fire or the puncture of the safe and arm device, the trigger capacitor 25 will fail in a short circuit mode before any other components of the trigger circuit fail. Because a shorted capacitor cannot be charged, the high currents (1500 amperes) required by the flying plate detonator cannot be generated and the flying plate detonator will remain inert.

Figure 2B:
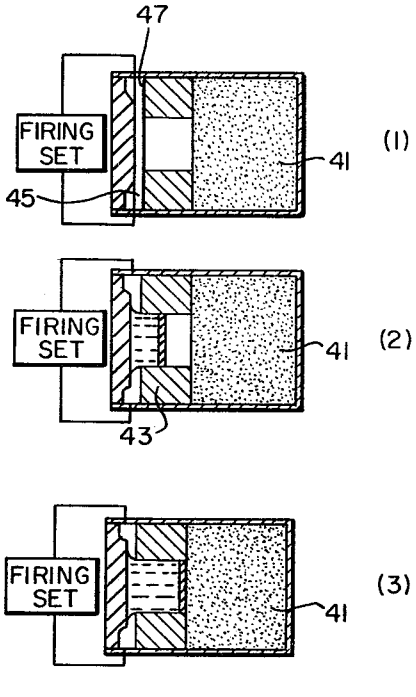
FIGS. 2(*a*) and 2(*b*) illustrate the structure and operation of a flying plate detonator usable with the safe and arm triggering circuit of the instant invention.
Figure 2A:
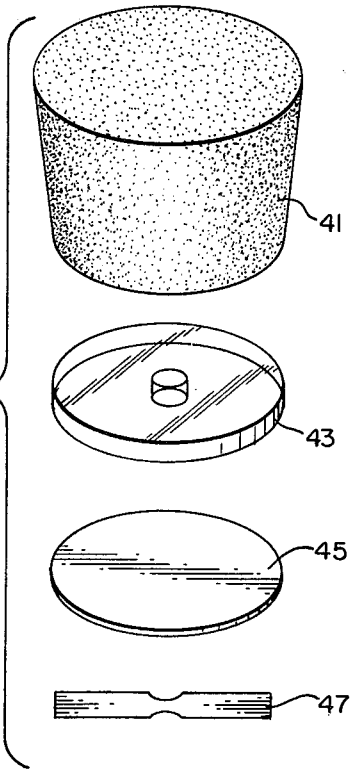

FIG. 2(*a*) illustrates the components constituting a flying plate detonator. These components include an HNS pellet 41 which is embedded in the shape charged explosive 15. A cap 43 with a central barrel is attached to one end of the HNS pellet 41. A thin plastic flyer 45 overlies the top of the cap 43. A thin metal foil 47 is attached to the flyer 45 and connected between the discharge side of the trigger capacitor 25 and ground.

As shown in FIG. 2(*b*)(1) the application of the high current trigger signal from the trigger capacitor 25 explosively vaporizes the thin metal foil 47 in a fraction of a microsecond. The resulting metal vapor shears the thin plastic flyer 45 (FIG. 2(*b*)(2)) and accelerates a portion of the flyer 45 down the barrel of the cap 43. The barrel is approximately 1 mm in length. The impact of a sheared portion of the flyer 45 (FIG. 2(*b*)(3)) and the HNS pellet causes detonation thereof. The function time of the trigger circuit and the flying plate detonator is a few microseconds from receipt of the trigger signal to warhead detonation.

Figure 3:
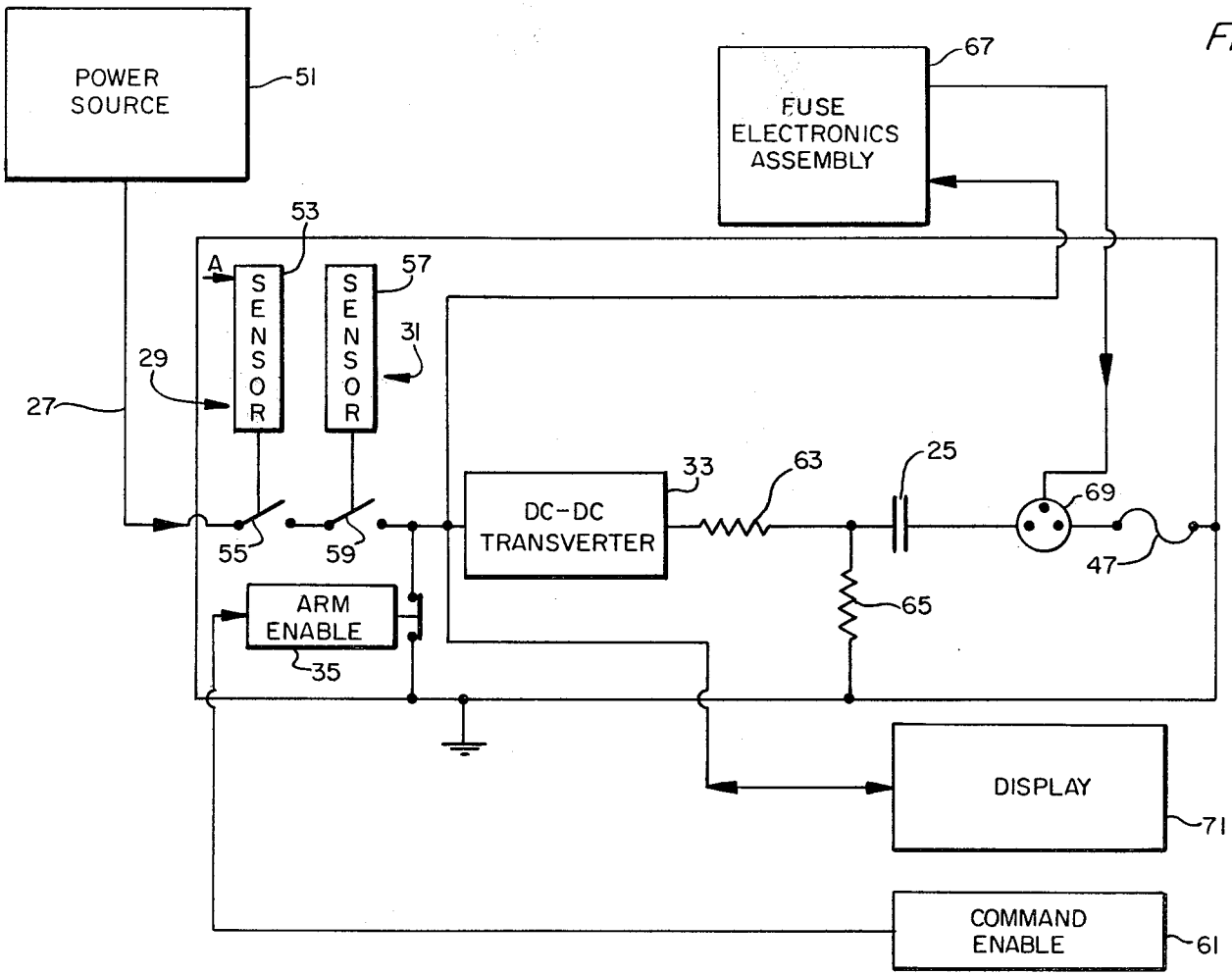
FIG. 3 is a circuit diagram of the safe and arm triggering circuit of the instant invention.

FIG. 3 is a schematic illustration of the trigger circuit of the instant invention. The power source 51 is connected to a means for selectively coupling the power source 51 to the trigger capacitor 25 to charge the trigger capacitor. As embodied herein, the coupling means comprises the DC-DC transverter 33 and means responsive to the flight of the warhead for transferring power from the power source 51 to the transverter 33. The transferring means as embodied as the first sensor switch 29 and the second sensor switch 31.

The first sensor switch 29 comprises a first controlling sensor 53 for opening and closing a first coupling switch 55. The second sensor switch 31 comprises a second controlling sensor 57 for opening and closing a second coupling switch 59. As stated above, the first sensor switch responds to the jettisoning of the nose cap covering the seeker on the warhead 11. A signal indicative of that occurrence is supplied at terminal A of the first controlling sensor 53. Upon receiving the nose cap jettison signal, the controlling sensor 53 closes the first coupling switch 55.

The second controlling sensor 57 comprises the Rolamite accelerometer described above. When the warhead 11 obtains a predetermined launch acceleration magnitude and direction at a time ensuring a safe separation distance from the warhead carrier, the second controlling sensor 57 will close the second coupling switch 59.

It is only when the first and second coupling switches 55 and 59 are closed that the power from the power source 51 is supplied to the transverter 33. However, the power will not be supplied to the transverter 33 even if switches 55 and 59 are closed unless the arm enable switch 35 is open. The arm enable switch is normally grounded and is controlled by a command enable module 61. The command enable module 61 responds to the above-described break wire condition to cause arm enable switch 35 to open and enable power to be supplied to transverter 33 when switches 55 and 59 are closed.

The output of the transverter 33 is connected to charging resistor 63 which in turn is connected to bleeder resistor 65 and the trigger capacitor 25. The trigger capacitor 25 is shunted to ground by the bleeder resistor 65 to ensure that a voltage cannot be maintained on the capacitor 25 in the absence of the power from the power source 51.

The trigger circuit further includes means responsive to the impact of the warhead against the target for enabling the discharge of the trigger capacitor 25 to generate the triggering signal. As embodied herein, the discharge enabling means comprises a fuse electronics assembly 67 which performs the above-described function of generating a signal at the time of warhead impact against a target. This signal is supplied to a gate 69. In the absence of the impact signal, the gate 69 constitutes an open circuit between the trigger capacitor 25 and the coil 47 of the flying plate detonator. Upon receiving the impact signal, however, the gate 69 enables the trigger capacitor 25 to discharge though the coil 47 to initiate detonation of the flying plate detonator.

A display and testing module 71 may be connected to the fuse electronics assembly 67 during the manufacture of the warhead 11 to perform selected test routines thereon. Moreover, the display and test module may be connected to a terminal (not shown) of the warhead following manufacture to enable confidence testing of the fuse assembly.

It will be further apparent to those skilled in the art, that modifications and variations can be made to the flying plate detonator trigger circuit without departing from the scope or spirit of the invention and it is intended that the present invention cover the modifications and variations of the circuit provided that they come within the scope of the appended claims and their equivalents.

I claim:

1. A safe and arm device for supplying a triggering signal to an explosive detonator of a shaped charge warhead flown to impact a target comprising:

a power source;

a toroidally-shaped trigger capacitor surrounding a portion of said shaped charge;

means for selectively coupling said power source to said trigger capacitor to charge said trigger capacitor; and means responsive to the impact of the warhead against the target for enabling the discharge of said capacitor to generate said triggering signal.

2. A safe and arm device according to claim 1 further including means responsive to the flight of said warhead for enabling said coupling means to supply said power from said power source to said trigger capacitor.

3. A safe and arm device according to claim 2 wherein said coupling means, said discharge enabling means, and said coupling enabling means are surrounded by said toroidally shaped trigger capacitor such that damage to said trigger capacitor will prevent the charging thereof by said coupling means and said coupling enabling means.

4. A safe and arm device according to claim 3 wherein said coupling means comprises a DC-DC transverter connected between said power source and said trigger capacitor.

5. A safe and arm device according to claim 2 or 4 wherein said coupling enabling means further includes a normally open first coupling switch and a first controlling sensor, said first controlling sensor for closing said first coupling switch responsive to said warhead's obtaining a predetermined acceleration level.

6. A safe and arm device according to claim 5 wherein said warhead is adapted to include a nose cap ejected a predetermined distance from the launch of said warhead and wherein said coupling enabling means includes a normally open second coupling switch and a second controlling sensor, said second controlling sensor for closing said second coupling switch responsive to the ejection of said nose cap.

7. A safe and arm device according to claim 6 wherein said coupling enabling means further includes an arm enable switch and means for actuating said arm enable switch responsive to the launching of said warhead.

8. A safe and arm device according to claim 1 wherein the explosive detonator comprises a flying plate detonator.

9. A safe and arm device according to claim 6 further including a bleeder resistor connected between said trigger capacitor and ground for preventing the charging of said trigger capacitor when either of said first coupling switch or said second coupling switch is open.

10. A safe and arm device for supplying a triggering signal to an explosive detonator of a warhead flown to impact a target comprising:

a power source;

a trigger capacitor means for selectively coupling said power source to said trigger capacitor to charge said trigger capacitor; and means responsive to the impact of the warhead against the target for enabling the discharge of said trigger capacitor to generate said triggering signal, said enabling means being surrounded by said trigger capacitor such that damage to said trigger capacitor will prevent the charging thereof by said coupling means.

11. A safe and arm device for supplying a trigger signal to an explosive detonator in a warhead flown to impact a target comprising:

a power source;

a trigger capacitor;

a DC-DC transverter for receiving power from said power source and for generating a signal for charging said trigger capacitor;

a first normally open switch and a second normally open switch, said first and second normally open switches being connected in series between said power source and said DC-DC transverter;

a first sensor for closing said first switch responsive to a first condition of said warhead;

a second sensor for closing said second switch responsive to a second condition of said warhead; and detonation switch means responsive to the impact of said warhead against said target for enabling the discharge of said trigger capacitor to generate said trigger signal.

* * * * *